US006889182B2

(12) United States Patent
Gustafsson

(10) Patent No.: US 6,889,182 B2
(45) Date of Patent: May 3, 2005

(54) SPEECH BANDWIDTH EXTENSION

(75) Inventor: Harald Gustafsson, Lund (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 669 days.

(21) Appl. No.: 10/022,245

(22) Filed: Dec. 20, 2001

(65) Prior Publication Data

US 2002/0138268 A1 Sep. 26, 2002

Related U.S. Application Data

(60) Provisional application No. 60/260,922, filed on Jan. 12, 2001.

(51) Int. Cl.[7] ..... G10L 19/02
(52) U.S. Cl. ..... 704/205
(58) Field of Search ..... 704/205–210, 704/229, 500–502

(56) References Cited

U.S. PATENT DOCUMENTS

| | | | | |
|---|---|---|---|---|
| 4,700,390 A | | 10/1987 | Machida | |
| 5,109,417 A | * | 4/1992 | Fielder et al. | 704/205 |
| 5,142,656 A | * | 8/1992 | Fielder et al. | 704/229 |
| 5,222,189 A | * | 6/1993 | Fielder | 704/229 |
| 5,230,038 A | * | 7/1993 | Fielder et al. | 704/229 |
| 5,479,562 A | * | 12/1995 | Fielder et al. | 704/229 |
| 5,792,073 A | * | 8/1998 | Keefe | 600/559 |

FOREIGN PATENT DOCUMENTS

| | | |
|---|---|---|
| JP | 09055778 | 2/1997 |
| WO | WO98/52187 | 11/1998 |
| WO | WO01/67437 | 9/2001 |

OTHER PUBLICATIONS

Y. Yoshida et al.: "An Algorithm to Reconstruct Wideband Speech From Narrowband Speech Based on Codebook Mapping", Conf. Proc. ICSLP 94, Yokohama, Japan, pp. 1591–1594.

(Continued)

*Primary Examiner*—David D. Knepper
(74) *Attorney, Agent, or Firm*—Potomac Patent Group PLLC

(57) ABSTRACT

A common narrow-band speech signal is expanded into a wide-band speech signal. The expanded speech signal gives the impression of a wide-band speech signal regardless of what type of vocoder is used. Extending the narrow-band speech signal into a lower range involves analyzing the narrow-band speech signal to generate one or more parameters, and synthesizing a lower frequency-band signal based on at least one of the one or more parameters. The synthesized lower frequency-band signal is then combined with a signal that is derived from (e.g., via up-sampling) the narrow-band speech signal. In preferred embodiments, a pitch frequency parameter is generated, and generation of the lower frequency-band signal includes generating continuous sine tones that are frequency shifted with the pitch frequency parameter.

20 Claims, 4 Drawing Sheets

OTHER PUBLICATIONS

J. Epps et al.: :Speech Enhancement Using STC–Based Bandwidth Extension, Conf. Proc. ICSLP 1998.

J. Makhoul et al.: "High–Frequency Regeneration in Speech Coding Systems", Conf. Proc. ICASSP, Washington, USA, 1979, pp. 428–431.

H. Yasukawa: "Quality Enchancement of Band Limited Speech by Filtering and Multirate Techniques", Conf. Proc. ICSLP 94, Yokohama, Japan, pp. 1607–1610.

Digital cellular telecommunications system (Phase 2 +); Voice Activity Detector (VAD) for Adaptive Multi–Rate (AMR) speech traffic channels; General description (GSM 06.94 version 7.1.1 Release 1998), ETSI EN 301 708 V7.1.1 (1999–12).

Wolfgang Hess: "Pitch Determination of Speech Signals", Springer–Verlag, 1983.

Yan Ming Cheng et al., Statistical recovery of wideband speech from narrowband speech, IEEE Transactions on Speech and Audio Processing, vol. 2, No. 4, Oct. 1994, pp. 544–548, XP000874178.

* cited by examiner

SPEECH BANDWIDTH EXTENSION

CROSS REFERENCE TO RELATED APPLICATIONS

This application claims the benefit of U.S. Provisional Application No. 60/260,922, filed Jan. 12, 2001, which is hereby incorporated herein by reference in its entirety.

BACKGROUND

The far most common way to receive speech signals is directly face-to-face with only the ear setting a lower frequency limit around 20 Hz and an upper frequency limit around 20 kHz. The common telephone narrowband speech signal bandwidth of 0.3–3.4 kHz is considerably narrower than what one would experience in a face-to-face encounter with a sound source, but it is sufficient to facilitate the reliable communication of speech. However, there would be a benefit to be obtained by extending this narrowband speech signal to a wider bandwidth in that the perceived naturalness of the speech signal would be increased.

Bandwidth extension methods previously suggested include codebook approaches (see, e.g., Y. Yoshida, M Abe, An algorithm to reconstruct wide-band speech from narrow-band speech based on codebook mapping, Conf. Proc, ICSLP 94, pp. 1591–1594, Yokohama, 1994; and J. Epps, W. H. Holmes, Speech enhancement using STC-based bandwidth extension, Conf. Proc. ICSLP, 1998) and aliasing/folding approaches (see, e.g., J. Makhoul, M. Berouti, High frequency regeneration in speech coding systems, Conf. Proc. ICASSP, pp. 428–431, Washington, USA, 1979; and H. Yasukawa, Quality enhancement of band limited speech by filtering and multirate techniques, Conf. Proc. ICSLP 94, pp. 1607–1610, Yokohama, 1994). The aliasing approach is generally simple in structure. In this approach, the narrow-band signal is up-sampled by inserting zeros between the narrow-band signal samples. When using such up-sampling, a reconstruction lowpass filter having a cut-off frequency at half the new sampling rate is used. When a shaping filter is substituted for this filter, the aliased/folded frequency content in the upper-frequency region extends the speech content. The drawbacks of this technique are that a harmonic speech structure is not continued in the upper-frequency region, and that a suitable amplitude level of the upper-frequency-band is generally not achieved for all speech sounds.

The codebook approach is a more advanced solution, in which the narrow frequency-band is analyzed with a codebook look-up method. The codebook index is matched one-to-one with a filter that is suitable for shaping an excitation signal. The excitation signal can, for example, be created with an aliasing/folding method. The codebook approach has also been tested for the lower frequency-band (see, e.g., the Y. Yoshida and M Abe reference cited above).

Speech signals are generally described by a short-time-segments model comprising a filter and a signal excitation. The filter describes the human vocal tract and the coupling between the excitation source and the vocal tract. The sound radiation characteristics from the mouth may also be included in this filter. Generally, it is sufficient to use an all-pole filter to estimate the vocal tract, coupling, and radiation characteristics, This filter then will only vaguely approximate zeros introduced by, for example, a nasal tract, or lateral consonants. This estimation problem can be reduced by increasing the filter order.

Speech signals are considered to be stationary during segments of 10–30 ms. This segment duration is determined by the fact that it takes approximately 70 ms for tissue in the vocal tract to change from one end-position to another. Hence, the vocal tract and the speech sounds can be completely different after this interval, but rarely after shorter durations of time.

During voiced speech segments, the poles of the filter can be described as estimates of the formants of speech, and also the coupling between the formant and the excitation source. The formants are the resonance frequencies of the vocal tract, either the whole or parts of it. Hence, the amplitude level at these formant frequencies is larger compared to adjacent frequencies, assuming the vocal folds source is present.

During unvoiced speech segments, the poles of the filter do not describe the formants, although the poles of the filter describe the resonance frequencies of the vocal tract, or more correctly the oral tract. The unvoiced speech is generated with almost no use of the lower part of the vocal tract. The number of noticeable resonances is often limited to one or two in the oral tract because of the short length of the cavity. Another aspect of the short resonators common for unvoiced speech segments is that the speech content is high in frequency, generally having prominent and perceptually important content above 3.4 kHz.

The sources that excite the filter can be divided into two types: the quasi-periodic and the turbulent noise source. The vocal folds in the larynx are the main source during voiced speech segments. This source is of a quasi-periodic type, normally having a fundamental frequency in the range of 70–400 Hz. This fundamental frequency is also called the pitch frequency, and a person can, during speech, increase the pitch frequency by about 100% compared to a relaxed state. The signal generated by the vocal folds look like a skewed half-wave rectified sinus, and thereby also generates harmonics. The harmonics are perceptually important due to the fact that formants are grouped according to their excitation's fundamental frequency; that is, formants having the same fundamental frequency will form a speech sound. It has been shown that in concurrent speech environments the fundamental frequency is even more important than the direction of the sound.

The turbulent noise source is generated by steering, with a constriction, an air stream against an obstacle or only causing a turbulent air volume velocity. When an obstacle is used, the resulting noise amplitude level is higher. Noise sources can be generated at many locations in the vocal tract, but the most prominent ones are generated in the oral cavity.

The perception of speech by the human hearing mechanism has some important functionalities. Human hearing is commonly described as having a logarithmic sensitivity with respect to both frequency and amplitude level. As a result, low frequencies carry more information in smaller frequency-bands. One way of describing this is the Barkscale, having frequency bands of 100 Hz in the lower frequency region and approximately 1 kHz in the upper frequency region. The amplitude level is often presented in decibels since this logarithmic scale is quite consistent with the amplitude level sensitivity of human hearing, or the loudness perception.

SUMMARY

It should be emphasized that the terms "comprises" and "comprising", when used in this specification, are taken to specify the presence of stated features, integers, steps or components; but the use of these terms does not preclude the presence or edition of one or more other features, integers, steps, components or groups thereof.

It is desirable to facilitate a perceptually acceptable extension of the narrow-band speech signal (300–3400 Hz) into a wide-band speech signal (50–3400 Hz).

In accordance with one aspect of the invention, it is possible to expand the narrow-band speech signal downward into a lower frequency band than is found in the narrow band speech signal. Accomplishing this includes analyzing the first narrow-band speech signal to generate one or more parameters; synthesizing a lower frequency-band signal based on at least one of the one or more parameters; and combining the synthesized lower frequency-band signal with a second narrow-band speech signal that is derived from the first narrow-band speech signal. In some embodiments, the second narrow-band speech signal is generated by a technique that includes up-sampling the narrow-band speech signal.

To facilitate synthesizing the lower frequency-band signal, the one or more parameters include a pitch frequency parameter. Synthesizing the lower frequency-band signal based on at least one of the one or more parameters includes generating continuous sine tones that are based on the pitch frequency parameter. In some embodiments, the narrow-band speech signal comprises a plurality of narrow-band speech signal segments. In such cases, the pitch frequency parameter can be estimated for each of the narrow-band speech signal segments; and the continuous sine tones can be changed gradually during a first part of each speech signal segment.

In another aspect, synthesizing the lower frequency-band signal based on at least one of the one or more parameters may further comprise adaptively changing an amplitude level of the continuous sine tones based on an amplitude level of at least one formant in the narrow-band speech signal segment. The at least one formant in the narrow-band speech signal segment is preferably a first formant in the narrow-band speech signal segment.

In yet another aspect, synthesizing the lower frequency-band signal based on at least one of the one or more parameters can further comprise lowpass filtering the continuous sine tones. This lowpass filtering of the continuous sine tones is preferably performed with an upper cutoff frequency substantially equal to 300 Hz.

BRIEF DESCRIPTION OF THE DRAWINGS

The objects and advantages of the invention will be understood by reading the following detailed description in conjunction with the drawings in which.

DETAILED DESCRIPTION

Figure 1:
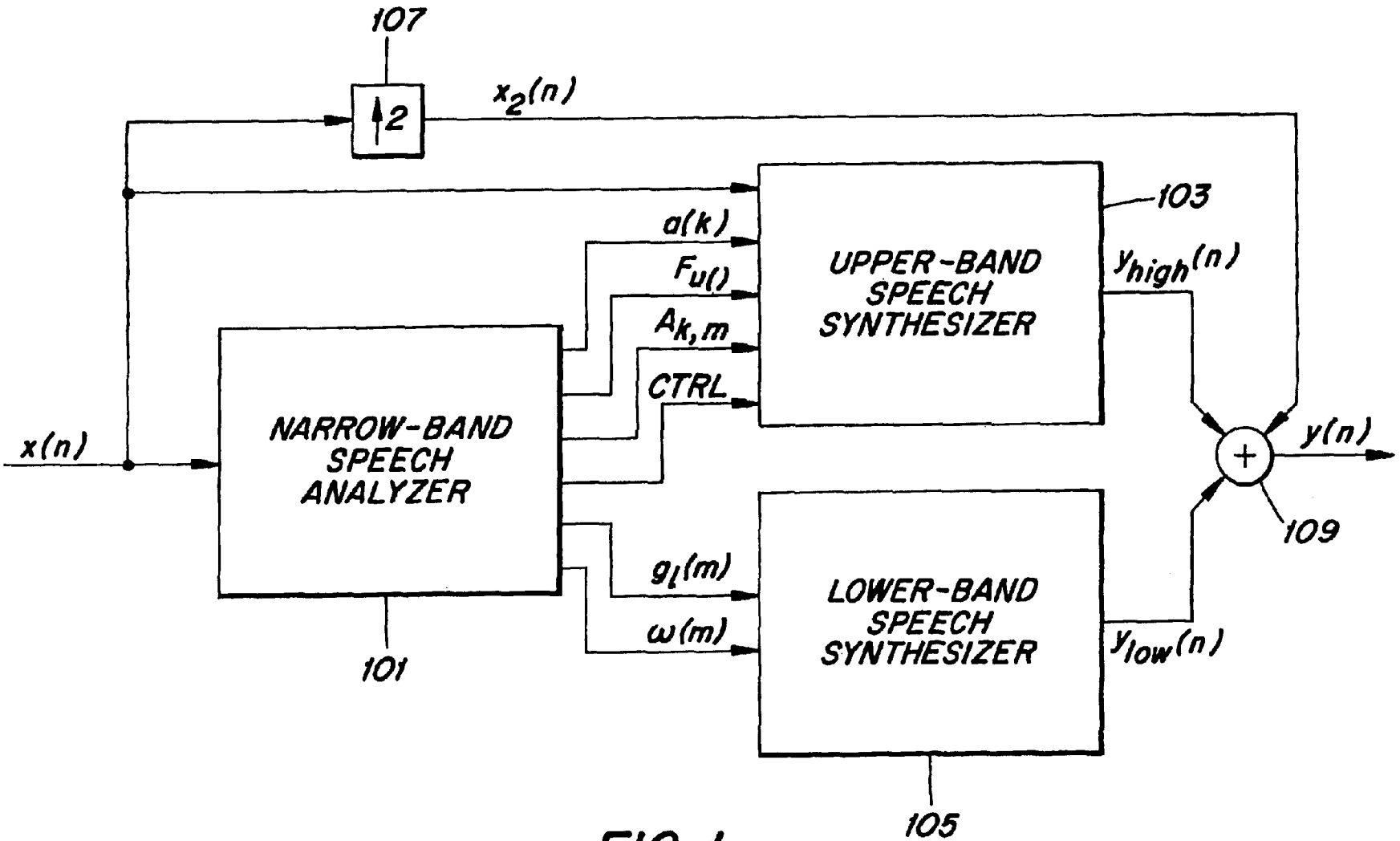
FIG. 1 is a block diagram of an exemplary technique for extending the bandwidth of a speech signal, in accordance with the invention.

The various features of the invention will now be described with reference to the figures, in which like parts are identified with the same reference characters.

The various aspects of the invention are described in connection with a number of exemplary embodiments. To facilitate an understanding of the invention, many aspects of the invention are described in terms of sequences of actions to be performed by elements of a computer system. It will be recognized that in each of the embodiments, the various actions could be performed by specialized circuits (e.g., discrete logic gates interconnected to perform a specialized function), by program instructions being executed by one or more processors, or by a combination above moreover, the invention can additionally be considered to be embodied entirely within any form of computer readable carrier, such as solid-state memory, magnetic disk, optical disk or carrier wave (such as radio frequency, audio frequency or optical frequency carrier waves) containing an appropriate set of computer instructions that would cause a processor to carry out the techniques described herein. Thus, the various aspects of the invention may be embodied in many different forms, and all such forms are contemplated to be within the scope of the invention. For each of the various aspects of the invention, any such form of embodiments may be referred to herein as "logic configured to" perform a described action, or alternatively as "logic that" performs a described action.

Since in the beginning, few telephones will have the wide-band vocoder facility, a technique is presented herein for expanding the common narrow-band speech signal into a wide-band speech signal using only the equipment in the receiving telephone. This will give the impression of a wide-band speech signal regardless of which vocoder is used. The robust technique described herein is based on speech acoustics and fundamentals of human hearing. That is, during voiced speech segments, the harmonic structure of the speech signal is extended, and the correct amount of speech energy relative to the energy of the common narrow frequency-band is introduced. During unvoiced speech segment, a fricated noise may be introduced in the upper frequency-band.

The bandwidth extension method can be divided into an analysis part and a synthesis part as shown in FIG. 1. In the exemplary embodiment depicted in FIG. 1, the analysis part comprises a narrow-band speech analyzer 101, which takes the common narrow-band signal as its input and generates the parameters that control the synthesis part. The synthesis part may comprise either an upper-band speech synthesizer 103, a lower-band speech synthesizer 105, or both as depicted in FIG. 1. The synthesis part generates the extended bandwidth speech signals, $y_{high}(n)$ and/or $y_{low}(i)$, which have a higher sampling rate (e.g., two times higher) than that of the input signal, x(n). In order to permit it to be combined with the synthesized signals, the original input signal is up-sampled by an up-sampling unit 107. The output of the up-sampling unit 107, $x_2$, is then combined with the extended bandwidth speech signals, $y_{high}(n)$ and $y_{low}(n)$ by a combining unit 109, which generates the resultant excitation signal y(n).

Figure 2:
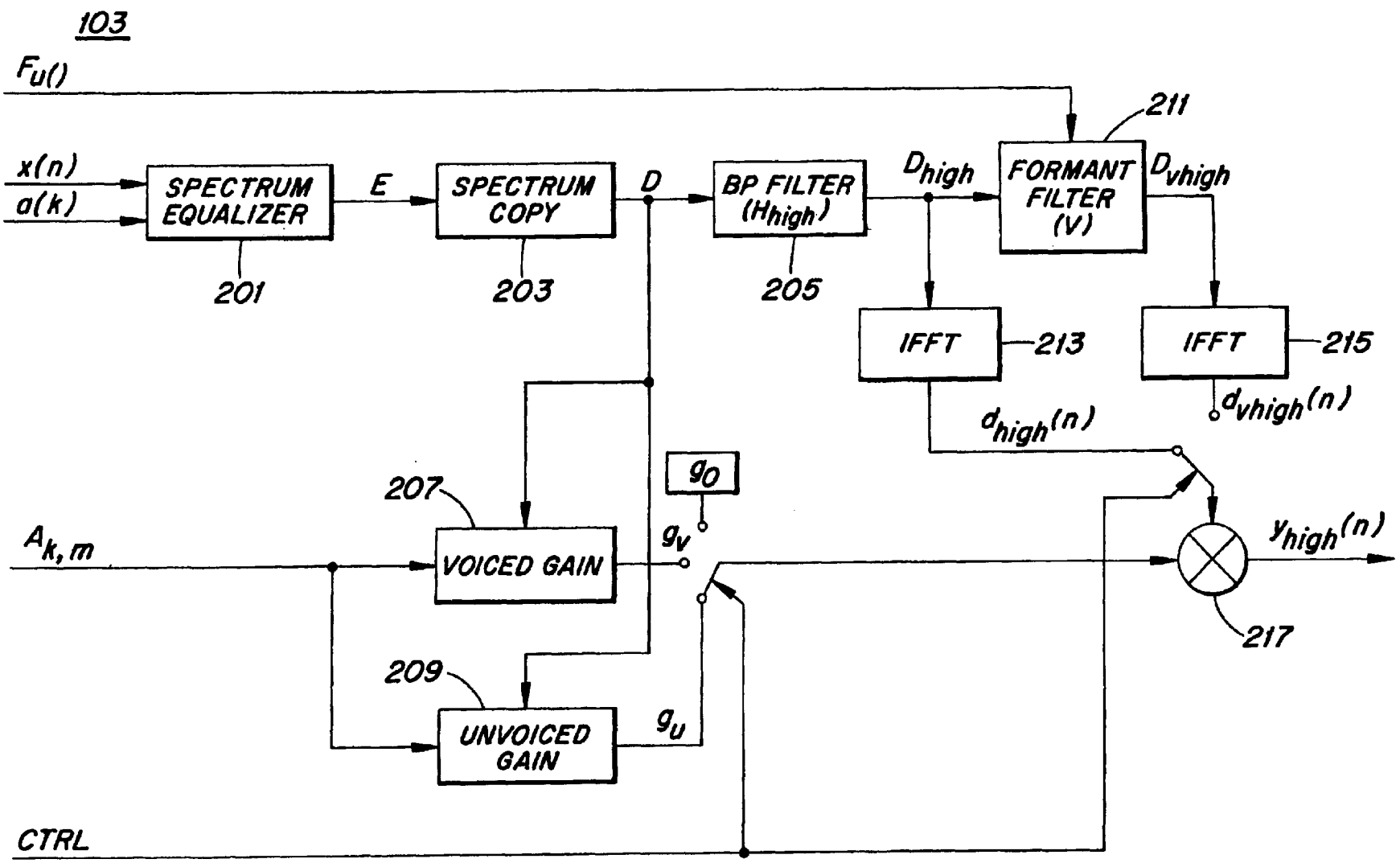
FIG. 2 is a block diagram of an upper-band speech synthesizer, in accordance with an aspect of the invention.

The upper-band speech synthesizer 103 comprises an excitation spectrum extender and filters that shape the speech content in the upper frequency-band as shown in FIG. 2. The excitation spectrum is expanded by using a spectrum equalizer 201 to equalize the amplitudes of the entire narrow-band speech spectrum, selected parts of which are then copied by a spectrum copy unit 203. This results in a signal having a higher sampling rate as compared to that of the input signal x(n), for example twice the sampling rate—but this could differ in other embodiments. The copying is performed such that a harmonic structure is continued. The resultant excitation signal, D, is then shaped by a bandpass filter 205 having a fixed configuration. The output of the bandpass filter 205 is a bandpass-filtered signal, $DH_{high}$. The purpose of the bandpass filter 205 is to introduce a descending amplitude level for higher frequencies and to cut off the frequency region below the upper-band. The gain of the extended spectrum is controlled by signals ($A_{k,m}$ and CTRL) generated by the narrow-band speech analyzer 101. The resultant excitation signal, D, is supplied to each of a voiced gain unit 207 and an unvoiced gain unit 209, which generate therefrom the respective gain signals $g_v$ and $g_u$ based on the amplitude control signal $A_{k,m}$. A third gain signal, $g_0$, is also provided. The third gain signal, $g_0$, is preferably a very low constant gain factor that is used when the corresponding speech is neither voiced nor fricated; that is, wen no actual speech is present in the speech signal, or when a speech sound is present in the speech signal but does not have significant high-band speech content as in the closure part of stop consonants. An aspect of the CTRL signal selects which of the three gain signals ($g_v$, $g_u$ and $g_0$) will be used to adjust the amplitude of the bandpass-filtered signal $DH_{high}$.

In another aspect of the invention, the amplitude spectrum shape can be further controlled more specifically with a formant filter 211, whose transfer function resembles a formant structure. The formant filter 211 operates on the bandpass-filtered signal $DH_{high}$, using filter characteristics provided by a formant filter control signal $F_{u(\ )}$ which is provided by the narrow-band speech analyzer 101. The formant filter 211 preferably has several peaks in the upper frequency-band. The formant peaks are preferably placed at equal frequency distances, having the same distance as the two highest formant peaks found in the narrow frequency-band. The output of the formant filter 211 is a formant-filtered signal $DVH_{high}$. An aspect of the CTRL signal (provided by the narrow-band speech analyzer 101) controls whether the bandpass-filtered signal $DH_{high}$ or alternatively the formant-filtered signal $DVH_{high}$ will be amplified by one of the three gain signals ($g_v$, $g_u$ and $g_0$) to generate the extended bandwidth speech signal, $y_{high}(n)$. These and other aspects of the upper-band speech synthesizer 103 are described in greater detail later in this description in connection with an exemplary embodiment of the invention.

As mentioned earlier, in conjunction with (or alternatively in lieu of) the bandwidth expansion upward in frequency, it is also possible to expand the bandwidth downward in frequency. The lower-band speech synthesizer 105, which serves this purpose, is shown in greater detail in FIG. 3. The narrow telephone bandwidth provided in conventional systems has a lower cut-off frequency of 300 Hz. The resolution of human hearing in frequency is logarithmic. Translating the bandwidths to the Barkscale (a traditional logarithmic frequency scale), the 50–300 Hz and 3400–7000 Hz regions become approximately three and four Barkbands wide, respectively. This implies that the lower region is also perceptually important. The speech content in this lower frequency region mostly comprises the pitch and its harmonics during voiced speech segments. During unvoiced speech segments, the lower frequency region is not perceptually important. The technique employed for estimating the speech content in this region, in accordance with this aspect of the invention, is to introduce sinus tones at the pitch frequency and the harmonics up to 300 Hz. Generally, the number of tones is four or less, since the pitch frequency is above 70 Hz. This is described in greater detail below.

Figure 4:
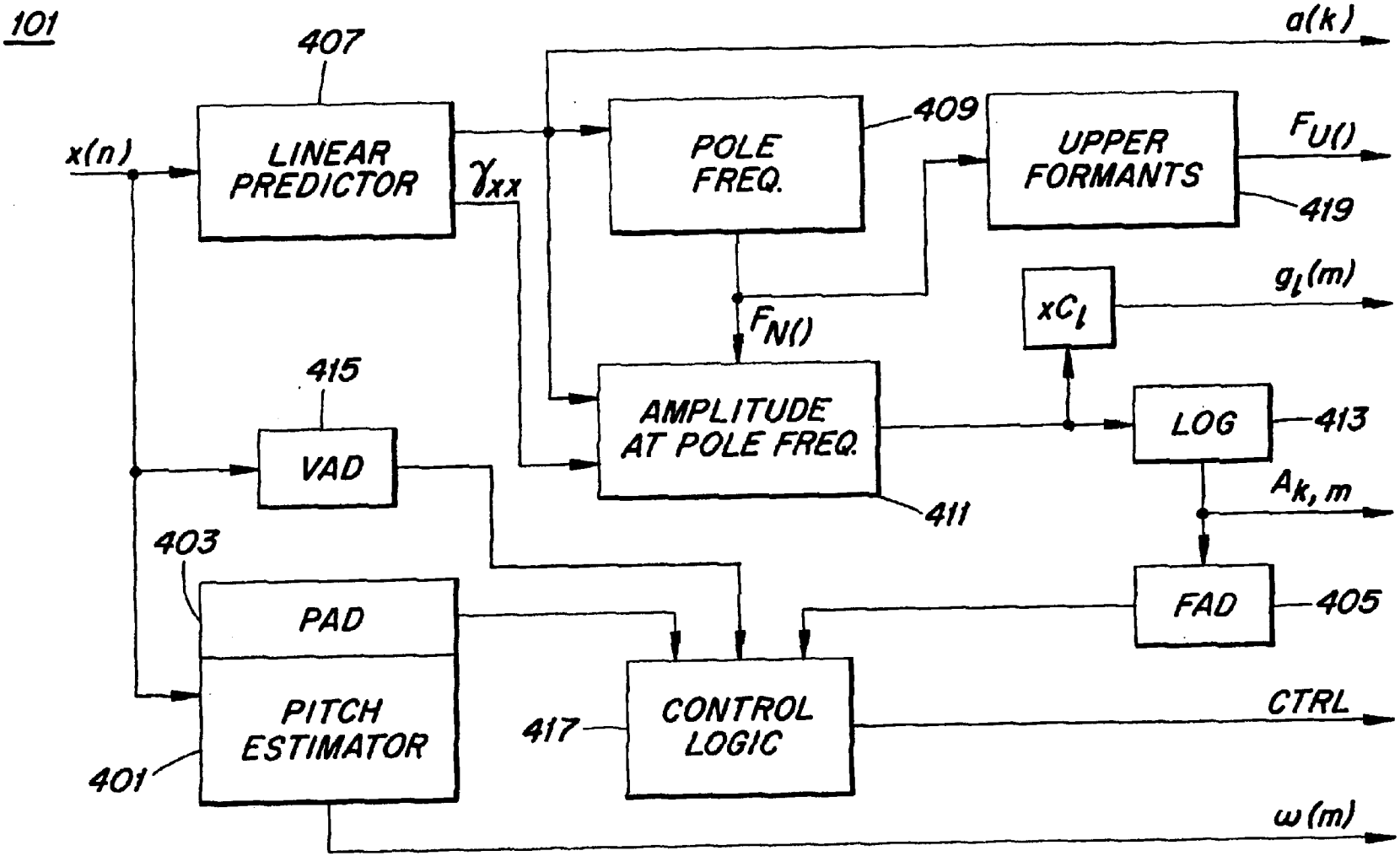
FIG. 4 is block diagram of a narrow-band speech analyzer, in accordance with an aspect of the invention.

The analysis part of the bandwidth expansion method mainly involves use of a pitch frequency estimator, a pitch activity detector (PAD) 403, a fricated speech detector (fricated activity detector, FAD) 405 and a formant peaks amplitude estimator (e.g, blocks 407, 409, 411 and 413, as described below), as shown in FIG. 4. The pitch activity detector 403 is used to decide the amount of gain to be used on the extended excitation spectrum. The general behavior of the narrow-band speech analyzer 101 is that fricated speech segments are preferably given a larger gain since, for example, fricatives have a substantial part of the speech energy in the upper frequency region. The pitch-frequency estimator 401 is used to calculate which frequencies the sinus tones introduced in the lower frequency region should have.

The formant peaks amplitude estimation is accomplished by estimating a linear predictor filter 407. The output of the linear predictor filter 407 is also used to calculate the excitation signal in the spectrum equalizer 201. The narrowband speech signal, x, is modeled by an all-pole filter a and an excitation signal e, $$x(n)=e(n)a(0)+e(n-1)a(1)+\ldots+e(n-p)a(p), \quad (1)$$

where p is the filter order. Equation (1) is valid during stationary signal conditions, which is approximately the case for individual speech segments. The model is then changed for each speech segment. The filter coefficients, a(n), are supplied to a pole frequency calculation unit 409 and to an amplitude calculation unit 411. The amplitude calculation unit 411 uses the filter coefficients a(n) and the pole frequency values, $F_{N(\ )}$, to calculate the amplitude values at the frequencies of the complex-conjugated poles. Different scaled versions of these amplitude values are then generated. In one version, the amplitude values are multiplied by a constant, $C_l$, to yield values, denoted $g_l(m)$, for use in the lower-band speech synthesizer 105. In another version, the amplitude levels are scaled by a logarithm scaling unit 413 to give a relatively more perceptually correct amplitude level, denoted herein as $A_{k,m}$, where k is both the estimated formant frequency number (e.g., 1, 2, 3, 4, . . . ) and the complex-conjugated pole-pair index (these should be the same) and m is the index separating the M segments, and is not a running segment number. The voiced gain unit 207 and fricated gain unit 209 in the upper-band speech synthesizer 103 calculate their respective gain values by linearly combining the logarithmic amplitude levels, $A_{k,m}$. Different combinators are used for voiced and fricated (unvoiced) speech segments. The gain is used to amplify the excitation spectrum, as explained earlier. Within the narrow-band speech analyzer 101, a fricated speech activity detector (FAD) uses other linear combinations of the logarithmic amplitude levels, $A_{k,m}$ to detect fricated speech sound. A voice activity detector 415 is further provided in the narrow-band speech analyzer 101 to generate a signal that indicates the presence or absence of speech in the input signal, x(n). The outputs of the pitch activity detector 403, the voice activity detector 415 and the fricated speech activity detector 405 are supplied to control logic 417 that generates the CTRL signals that are supplied to the upper-band speech synthesizer 103.

The pole frequency calculation unit 409 also supplies its output frequencies, $F_{N(\ )}$, to an upper formants synthesizer 419, which generates synthesized formants, $F_{U(\ )}$, for use in the upper-band frequency synthesizer 103. Generation of the synthesized upper formants, $F_{N(\ )}$, is described in greater detail below.

As mentioned earlier, the lower speech synthesized signal, $y_{low}(n)$ and upper speech synthesized signal, $y_{high}(n)$, are combined (e.g., added) to the up-sampled narrow-band signal, $x_2(n)$ to generate the final wideband speech signal:

$$y(n)=y_{low}(n)+y_{high}(n)+x_2(n). \tag{2}$$

Upper-Band Speech Synthesizer 103

The upper-band speech synthesizer 103 will now be described in greater detail in connection with an exemplary embodiment. The upper frequency-band that is generated in this exemplary embodiment has a frequency range of 3.4–7 kHz, although this could differ in other embodiments. This frequency range generally includes the fourth through eighth formants during voiced speech segments, but the highest are often not perceptually important. An unvoiced speech segment that includes, for example, a fricative or an affricate consonant has a substantial part of its speech energy in this frequency region.

Referring back now to FIG. 2, the excitation signal, e(n) (which is generated from the original signal x(n) by means of the filtering that is performed by the inverse linear predictor filter) is first extended upwards in frequency. One simple and robust method to accomplish this is to copy the spectrum from lower frequencies to higher frequencies. During this copying, it is very important to continue any harmonic structure. The spectrum of the excitation, E(f), is divided into three zones: the lower match zone, $E(f_l)$; the middle zone, $E(f_m)$; and the upper match zone, $E(f_u)$. The amplitude spectrum of the excitation, |E(f)|, will have a comb-like structure with the peaks at a distance of the pitch frequency during voiced speech segments. The spectrum equalizer 201 calculates the full complex spectrum on a grid of frequencies, $f_i$, i=0 . . . I−1 with a Fast Fourier Transform (FFT), where I represents the number of sampling frequency bins in the grid. The frequencies $f_i$ are examined for the maximum spectrum amplitude, $|E(f_i)|$, in each range $f_i \epsilon f_l$ and $f_i \epsilon f_u$:

$$|E(f_l,\max)|=\max|E(f_i)|,\ f_i \epsilon f_l, \tag{3}$$

$$|E(f_u,\max)|=\max|E(f_i)|,\ f_i \epsilon f_u.$$

A harmonic structure is continued since the maximum in the amplitude spectrum likely coincides with a harmonic tone of the pitch-frequency. When the speech segment is unvoiced, the technique operates in the same manner, even though no harmonic structure needs to be continued. Then, to extend the excitation spectrum into higher frequencies, the spectrum copy unit 203 repeatedly copies the spectrum between the two found maxima up until $f_{I-1}$ is reached:

$$\begin{cases} D(f_l) = & E(f_l),\ f_l = f_0, \ldots, f_{u,\max}, \\ D(f_l + c) = & E(f_i),\ f_l = f_{l,\max}, \ldots, f_{u,\max}, \\ & c = (1, 2, \ldots)\cdot(f_{u,\max} - f_{l,\max}), \\ & f_l + c < f_I, \\ D(f_l) = & E(f_{I/2}) \end{cases} \tag{4}$$

The complex conjugated mirrored part of the spectrum, inherent of real-valued time signals, is calculated from:

$$D(f_{I+i})=D^*(f_{I-i}),\ i=1, 2, \ldots, I-1. \tag{5}$$

This results in the bandwidth expanded excitation spectrum D having a doubled sample rate. The spectrum D can also be constructed by means of a combination of interpolation, filtering and transpositions.

The bandwidth expanded excitation spectrum D is then filtered by a bandpass filter 205. This yields a filtered expanded excitation spectrum, $D_{high}$:

$$D_{high}=D\cdot H_{high} \tag{6}$$

In the exemplary embodiment, the bandpass filter 205 has a filtering characteristic, $H_{high}$(=$h_{high}$ in the time domain), that has a lower cut-off frequency of 3400 Hz and a continuously descending level for higher frequencies.

In some embodiments, in order to enhance the perceived speech signal, the upper-band speech synthesizer 103 may further include a formant filter 211 which gives spectral peaks at estimated formant frequencies in the upper frequency range, $F_{U1}$, $F_{U2}$, . . . In the exemplary embodiment, the formant filter 211 has one complex conjugated pole-pair and one complex conjugated zero-pair for each synthetic formant frequency, with the poles having larger amplitudes:

$$V(f) = \mathcal{F}\left(v_0 \frac{(1 - r_z(1)e^{j2\pi F_{U1}})(1 - r_z(1)e^{-j2\pi F_{U1}})}{(1 - r_p(1)e^{j2\pi F_{U1}})(1 - r_p(1)e^{-j2\pi F_{U1}})} \cdot \frac{(1 - r_z(2)e^{j2\pi F_{U2}})(1 - r_z(2)e^{-j2\pi F_{U2}})}{(1 - r_p(2)e^{j2\pi F_{U2}})(1 - r_p(2)e^{-j2\pi F_{U2}})} \cdots\right) \tag{7}$$

where $r_z$ is the constant amplitude of the zeros, $r_p$ is the constant amplitude of the poles and $v_0$ is a fixed normalizing gain. The arrangement of the exemplary formant filter 211 reduces the interference between the poles compared with a filter having only poles. The poles and zeros have lower amplitudes for higher formant frequencies in order to bring about an increasing bandwidth for higher formant frequencies. The distances in frequency between the formants are preferably equal. The equal distance is motivated by the fact that formants in the higher frequency region are most often resonances in the front-most cavity, or tube, of the vocal tract and hence are multiples of a lowest resonance frequency. The frequency distance calculation is presented below in the section entitled "Narrow-Band Speech Analyzer 101."

The output, $D_{vhigh}$, of the formant filter is thus given by:

$$D_{vhigh}=V\cdot D_{high} \tag{8}$$

In preferred embodiments, the upper-band speech synthesizer 103 may alternatively be based on either bandpass-filtered signal, $D_{high}$, or the formant-filtered signal, $D_{vhigh}$. The selection is made by the CTRL signal. Thus, a first Inverse Fast Fourier Transform unit (IFFT) 213 is provided to convert the bandpass-filtered signal into the time domain:

$$d_{high}(n)=F^{-1}(D_{high}), \tag{9}$$

and a second IFFT 215 is provided to convert the formant-filtered signal into the time domain:

$$d_{vhigh}(n)=F^{-1}(D_{vhigh}) \tag{10}$$

The upper-band speech synthesizer 103 preferably includes a suitable amplifier 217 that amplifies the extended excitation spectrum by an amount, g, based on the level in the narrow-band frequency region. The output of the upper-band speech synthesizer 103 is therefore either:

$$y_{high}(n)=g\cdot d_{high}(n) \tag{11}$$

or $$y_{high}(n)=g\cdot d_{vhigh}(n), \tag{12}$$

depending on the value of the CTRL signal.

The gain, g, is calculated differently, depending on whether the speech signal in the current speech segment represents voiced or unvoiced speech. When the current segment contains voiced speech, with a detected pitch, the voiced gain unit 207 generates a voiced gain signal, $g_v$, that is derived from the logarithmically scaled amplitudes at the frequencies of the pole, $F_{N1}, F_{N2}, \ldots F_{NN}$, in the linear prediction filter:

$$A_{k,m} = \log_{10}\sqrt{\frac{\sum_{l=0}^{p} a_m(l)\cdot\gamma_{xx,m}(l)}{\left|\sum_{l=0}^{p} a_m(l)\cdot e^{-j2\pi l f_{Nk}}\right|^2}} \tag{13}$$

$$\tilde{g}_v = \sum_{k=1}^{p} A_{k,m}\cdot h_v(k) \tag{14}$$

$$g_v = \frac{10^{\tilde{g}_v}}{\frac{1}{i}\sqrt{\sum_{l=0}^{l} D(f_l)^2}}, \tag{15}$$

where p is the order of the linear predictor filter 407; $\gamma_{xx,m}$ is the auto-correlation of the narrow-band signal over the last M-1 voiced segments and the current unvoiced segment; $h_v$ is the linear combinator of the log amplitudes, $A_{k,m}$; $a_m(l)$ are the linear predictors over the last M-1 voiced segments and the current unvoiced segment; and m=1 for voiced segments. The logarithm of the amplitudes is used because this complies with the perception of amplitude levels and it is likely that the gain level should be dependent on the log amplitudes.

During unvoiced speech segments with fricated speech, the unvoiced gain signal, $g_u$, is determined as a function of the log amplitude levels over the last M-1 voiced segments and the current unvoiced segment:

$$\tilde{g}_u = \sum_{m=1}^{M}\sum_{k=1}^{p} A_{k,m}\cdot h_u(k,m) \tag{16}$$

$$g_u = \frac{10^{\tilde{g}_v}}{\frac{1}{I}\sqrt{\sum_{i=0}^{I} D(f_l)^2}}, \tag{17}$$

where $A_{k,m}$ are the log amplitudes for the last M-1 voiced segments and the current segment. That is, given a mix of voiced and unvoiced segments, one would have to reach back more than M-1 previous segments in order to find the M-1 most recent voiced segments. A value of M is preferably determined empirically, with a value of 10 often being sufficiently high. The final gain, g, is then given by:

$$g = \begin{cases} g_v, & \text{when voiced} \\ g_u, & \text{when fricated} \\ g_0, & \text{neither voiced nor fricated} \end{cases} \tag{18}$$

where $g_0$ is a very low constant gain factor. More particularly, $g_0$ is preferably at least 20 dB below the long time average for the other gains, but more generally it is a constant that should depend on the application. For example, it may be preferred, in some applications, to also copy the background sound to the high band, whereas in other applications a total mute of the background in the high band may be preferred. In the exemplary embodiment illustrated in FIG. 2, the selection represented in Equation (18) is made by the CTRL signal.

Lower-Band Speech Synthesizer 105

Figure 3:
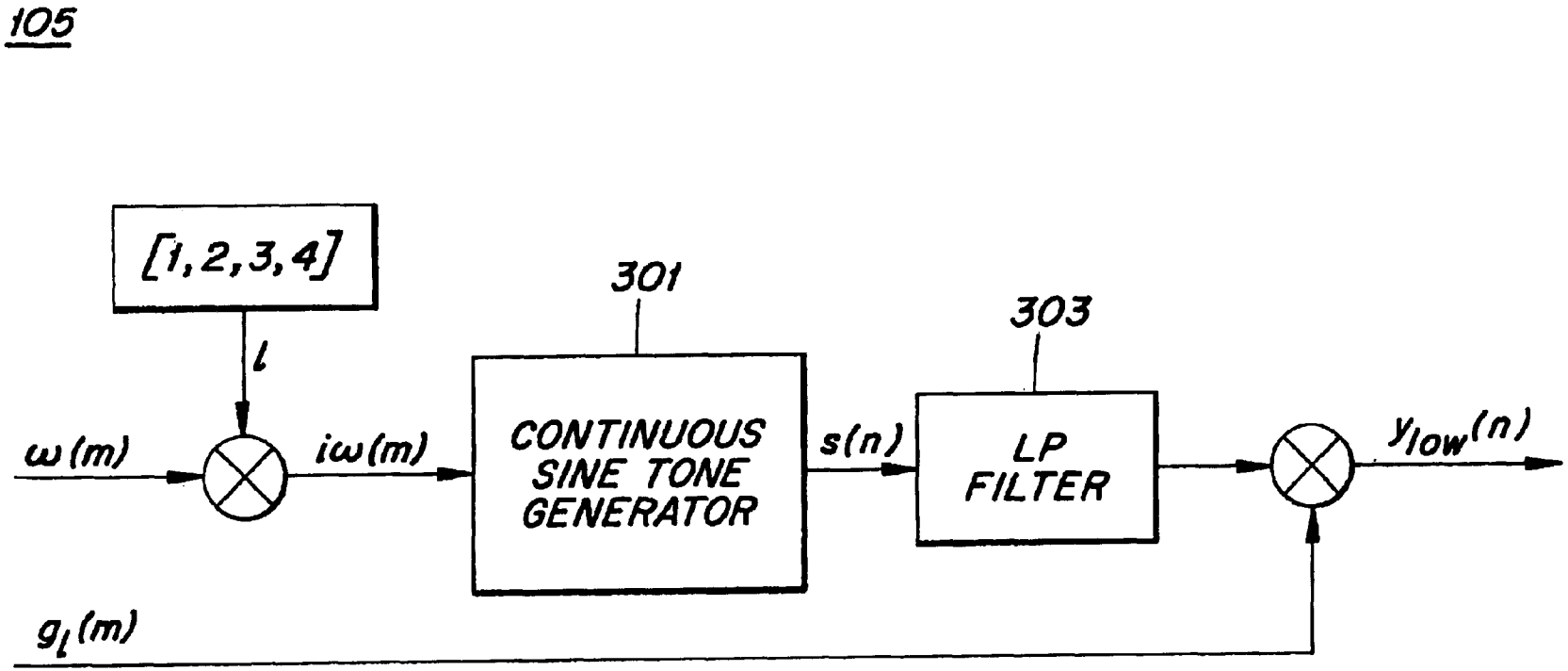
FIG. 3 is a block diagram of a lower-band speech synthesizer, in accordance with an aspect of the invention.

The lower-band speech synthesizer 105 will now be described in greater detail in connection with an exemplary embodiment, shown in FIG. 3. The lower frequency-band that is generated in this exemplary embodiment has a frequency range of 50–300 Hz, although this could differ in other embodiments. This frequency range mainly has voiced speech content. The excitation spectrum of voiced speech is the pitch frequency and its harmonics. The harmonics decrease in amplitude with increasing frequency. The excitation spectrum is filtered by a formant structure and for the lower frequency range the first formant is of importance. The first formant is in the approximate range of 250–850 Hz during voiced speech. As a result, the natural amplitude levels of the harmonics in the frequency range 50–300 Hz are either approximately equal or have a descending slope towards lower frequencies. Low frequency tones are capable of perceptually masking higher frequencies substantially—this is the so-called upward spread of masking. This implies that caution must be taken when introducing tones in the low frequency region. Accordingly, the estimated gain is preferably taken to be less than the estimated amplitude of the first formant peak. The suggested bandwidth extension downward in frequency is accomplished by means of a continuous sine tone generator 301 that introduces continuous sine tones. The amplitude levels of all the sine tones are adaptively changed, with a fraction of the amplitude level of the first formant:

$$g_l(m) = C_l \cdot \sqrt{\frac{\sum_{l=0}^{p} a(l) \cdot \gamma_{xx}(l)}{\left|\sum_{l=0}^{p} a(l) \cdot e^{-j2\pi l f_N l}\right|^2}}, \tag{19}$$

where $C_l$ is a constant and m is the running segment number.

The low frequency continuous sine tone generators 301 are based on the pitch frequency and integer multiples of the pitch frequency. The pitch is estimated for each speech segment. To avoid discontinuities in the sine tones, the tones are changed gradually during a first part of each segment. For each integer multiple, i, of the pitch frequency, the continuous sine tone generator 301 generates each sine tone signal, $s_i(n)$, in accordance with:

$$s_i\langle n\rangle = \begin{cases} \left(g_l(m-1) + n\frac{g_l(m) - g_l(m-1)}{L_l}\right)\sin\left(i(\phi(m)+n)\left(\omega(m-1) + n\frac{\omega(m)-\omega(m-1)}{L_l}\right)\right), & n = 0, \ldots, L_l \\ g_l(m)\sin(i(\phi(m)+n)\omega(m)), & n = L_l + 1, \ldots, L-1 \end{cases} \tag{20}$$

where $\phi(m)$ is the phase compensation needed to maintain a continuous sinusoid between segments, $\omega(m)$ is the pitch frequency of the current segment m, L is the number of samples in the segment, and $L_l$ is the end sample of the soft transition within segments. The complete synthesized lower speech signal s(n), is then given by:

$$s(n) = \sum_{i=1}^{4} s_i(n), \tag{21}$$

which also is then optionally filtered by an optional lowpass filter 303 that, in this example, has a limit of 300 Hz. In Equation (21), the summation range of i=1, . . . , 4 is presented here merely as an example. In practice, the range should be selected such that all sine tones will be added together. The resultant output signal, $y_{low}(n)$, is given by:

$$y_{low}(n) = g_l(m) \cdot \sum_{k=0}^{P_{low}} s(n-k)h_{low}(k). \tag{22}$$

Narrow-Band Speech Analyzer 101

Referring now to FIG. 4, the narrow-band speech is estimated with a model of a linear prediction filter (linear predictor 407) and an excitation signal (see Equation (1)).

The placement of the synthetic formant frequencies ($F_{U(\ )}$) in the upper frequency region is based on the estimated formant frequencies ($F_{N(\ )}$) in the narrow-band speech signal. The estimated linear prediction filter 407 has poles at the formant frequencies of the narrow-band speech signal. In preferred embodiments, the poles at the two highest frequencies, $F_{N(N-1)}$ and $F_{NN}$, are used in the analysis of the placement of the synthetic formants. The reason for this is that these estimated formant frequencies are most likely to be resonances of the same front-most tube. If this front-most tube is considered to be uniform, open in the front end, and closed in the back end, the resonances occur at, $$f = \frac{2n-1}{4} \cdot \frac{c}{l}, n = 1, 2, 3, \ldots \tag{23}$$

where c=354 m/s at body temperature and 1 atmosphere pressure, and l is the length of the tube. The parameters in Equation (23) can be estimated by calculating the average n, and c/l can be calculated by the frequency distance, $$n_{N(N-1)} = \text{round}\left(\frac{F_{N(N-1)} + F_{NN}}{2(F_{NN} - F_{N(N-1)})}\right) \tag{24}$$

$$\frac{c}{l} = 2(F_{NN} - F_{N(N-1)}) \tag{25}$$

The fraction c/l is then also limited: A maximum tube length of 20 cm is a reasonable physical limit, which gives a lower distance limit between the resonance frequencies of 0.9 kHz.

The synthetic formant frequencies, $F_{U(\ )}$, are then calculated with Equation (23), for $n=n_{N(N-1)}+2$, $n_{N(N-1)}+3$, . . . corresponding to $F_{U1}$, $F_{U2}$, . . . .

The detectors used in the analysis part are: a fricated speech activity detector (FAD 405), a voiced/unvoiced (pitch) decision maker (PAD 403), and a general voice activity detector (VAD 415). VADs 415 are well known, and need not be described here in great detail. A possible choice is the VAD used in the GSM AMR vocoder specification (see Voice Activity Detector (VAD) for Adaptive Multi-Rate (AMR) speech traffic channels, GSM 06.94, ver 7.1.1, ETSI, 1998). The voiced/unvoiced decision is derived from a pitch frequency estimator. Pitch frequency estimators and detectors are also well known, and need not be described here in great detail. See, for example, W. Hess, Pitch determination of speech signals. Springer-Verlag, 1983.

The fricated speech activity detector (FAD 405) is used to detect when the current speech segment contains fricative or affricate consonants. This can then be used to select a proper gain calculation method. The fricated speech activity detector is similar in structure to the linear gain estimation methods. The first stage in the detector calculates a linear combination, $h_f(k,m)$, of the estimated formant peak amplitudes, $A_{k,m}$ in the current segment as well as in the last M-1 segments with pitch:

$$o = \sum_{m=1}^{M} \sum_{k=1}^{p} A_{k,m} \cdot h_f(k, m). \tag{26}$$

The estimated value o is low when the current segment contains fricated speech. An exponential average of o over segments with voiced speech is taken, forming $\bar{o}$. When the estimated value o is below the average $\bar{o}$ the segment is estimated to contain a fricated speech sound.

The upper-frequency-band speech synthesizer 103 uses different upper-band gains, depending on whether it is synthesizing an upper frequency-band signal for voiced speech, fricated speech, or neither voiced nor fricated speech. These situations can be determined with the above described detectors and control logic as $$\begin{cases} \text{voiced,} & VAD \,\&PAD \\ \text{fricated,} & VAD \,\&\overline{PAD}\,\&FAD \\ \text{neither,} & \overline{VAD}|(\overline{PAD}\,\&\overline{FAD}) \end{cases} \tag{27}$$

where "&" represents a logical AND operator, "|" represents a logical OR operator, and a "bar" over a variable represents a logical NOT operator.

The invention has been described with reference to a particular embodiment. However, it will be readily apparent to those skilled in the art that it is possible to embody the invention in specific forms other than those of the preferred embodiment described above. This may be done without departing from the spirit of the invention.

For example, the upper-band speech synthesizer 103 could be embodied in ways other than the exemplary embodiment described with respect to FIG. 2. In one alternative, the bandpass filter 205 is eliminated entirely, with the output of the spectrum copy unit 203 being supplied directly to the formant filter 211. This is a viable alternative because a reduction below 3400 Hz can be accomplished with the formant filter 211, and during fricated speech periods (i.e., when the output of the formant filter is not selected) this reduction is not very important.

In another alternative of the upper-band speech synthesizer 103, the bandpass filter 205 is replaced by a highpass filter.

In yet another alternative of the upper-band speech synthesizer 103, the spectrum copy unit 203 is replaced by a spectrum move unit that first performs the copying function and then zeroes out the section that has been copied.

In still another alternative of the upper-band speech synthesizer 103, the bandpass filter 205 and formant filter 211 can be eliminated entirely—if the content below 3400 H is left without a reduction in the upper-band synthesis signal it would be quite disturbing to the listener, but it could be left in place, with a clear degradation in speech quality.

The tube model of the vocal tract upon which the above-described embodiments are based is a simple one. In yet other alternative embodiments, those skilled in the art will readily be able to apply the same principles set forth above in an application based on a more advanced tube model.

Furthermore, in the description of the FAD and the gains, as set forth above, the terms "proportional" and "linear" are used. However, in still other alternatives, non-linear processing may be used instead. This may be performed, for example, by means of an artificial neural network (ANN), configured in for example a feed-forward-back-propagation or radial basis network. One ANN takes the $A_{k,m}$ as input, and generates the $\tilde{g}_u$ of Equation (16) as output. Yet another ANN takes the $A_{k,m}$ as input and generates o of Equation (26) as output.

Finally, it is additionally noted that, in embodiments in which the lower-band synthesis is performed without the upper-band synthesis, there is no need for an up-sampling of the narrow-band signal.

Thus, the preferred embodiment is merely illustrative and should not be considered restrictive in anyway.

What is claimed is:

1. A method of generating a wide-band speech signal from a first narrow-band speech signal, the method comprising:

analyzing the first narrow-band speech signal to generate one or more parameters;

synthesizing a lower frequency-band signal based on at least one of the one or more parameters; and combining the synthesized lower frequency-band signal with a second narrow-band speech signal that is derived from the first narrow-band speech signal, wherein:

the one or more parameters include a pitch frequency parameter; and synthesizing the lower frequency-band signal based on at least one of the one or more parameters comprises generating continuous sine tones that are based on the pitch frequency parameter.

2. The method of claim 1, further comprising generating the second narrow-band speech signal by a technique that includes up-sampling the narrow-band speech signal.

3. The method of claim 1, wherein the second narrow-band speech signal is the first narrow-band speech signal.

4. The method of claim 1, wherein:

the narrow-band speech signal comprises a plurality of narrow-band speech signal segments;

the pitch frequency parameter is estimated for each of the narrow-band speech signal segments; and the continuous sine tones are changed gradually during a first part of each speech signal segment.

5. The method of claim 4, wherein synthesizing the lower frequency-band signal based on at least one of the one or more parameters further comprises adaptively changing an amplitude level of the continuous sine tones based on an amplitude level of at least one formant in the narrow-band speech signal segment.

6. The method of claim 5, wherein the at least one formant in the narrow-band speech signal segment is a first formant in the narrow-band speech signal segment.

7. The method of claim 5, wherein adaptively changing the amplitude level of the continuous sine tones based on the amplitude level of at least one formant in the narrow-band speech signal segment comprises:

adaptively changing an amplitude level of the continuous sine tones by an amount, $g_l(m)$, given by:

$$g_l(m) = C_l \cdot \sqrt{\frac{\sum_{l=0}^{p} a(l) \cdot \gamma_{xx}(l)}{\left|\sum_{l=0}^{p} a(l) \cdot e^{-j2\pi l f_{Nl}}\right|^2}},$$

where $C_l$ is a constant; m is a segment number; $\gamma_{xx}$ is an autocorrelation value of the narrow-band speech signal, x; $f_{Nl}$ is a frequency of a first formant of the narrow-band speech signal; and p is an order of a linear prediction filter.

8. The method of claim 5, wherein the continuous sine tones, s(n), are generated in accordance with:

$$s(n) = \sum_{i=1}^{N} s_i(n),$$

where the summation range i=1 to N is selected such that all sine tones will be added together, and:

$$s_i(n) = \begin{cases} \left(gi(m-1) + n\frac{gi(m) - gi(m-1)}{L_l}\right)\sin\left(i(\phi(m)+n)\left(\omega(m-1) + n\frac{\omega(m)-\omega(m-1)}{L_l}\right)\right), & n = 0, \ldots, L_l \\ gi(m)\sin(i(\phi(m)+n)\omega(m)), & n = L_l + 1, \ldots, L-1 \end{cases}$$

where $\phi(m)$ is a phase compensation needed to maintain a continuous sinusoid within segments, $\omega(m)$ is the pitch frequency of a current speech signal segment m, L is the number of samples in each speech signal segment, and $L_l$ is the end sample of the soft transition within each speech signal segment.

9. The method of claim 1, wherein synthesizing the lower frequency-band signal based on at least one of the one or more parameters further comprises lowpass filtering the continuous sine tones.

10. The method of claim 9, wherein lowpass filtering the continuous sine tones is performed with an upper cutoff frequency substantially equal to 300 Hz.

11. An apparatus for generating a wide-band speech signal from a first narrow-band speech signal, the apparatus comprising:

logic that analyzes the first narrow-band speech signal to generate one or more parameters;

logic that synthesizes a lower frequency-band signal based on at least one of the one or more parameters; and logic that combines the synthesized lower frequency-band signal with a second narrow-band speech signal that is derived from the first narrow-band speech signal, wherein:

the one or more parameters include a pitch frequency parameter; and the logic that synthesizes the lower frequency-band signal based on at least one of the one or more parameters comprises logic that generates continuous sine tones that are based on the pitch frequency parameter.

12. The apparatus of claim 11, further comprising logic that generates the second narrow-band speech signal by a technique that includes up-sampling the narrow-band speech signal.

13. The apparatus of claim 11, wherein the second narrow-band speech signal is the first narrow-band speech signal.

14. The apparatus of claim 11, wherein:

the narrow-band speech signal comprises a plurality of narrow-band speech signal segments;

the pitch frequency parameter is estimated for each of the narrow-band speech signal segments; and the continuous sine tones are changed gradually during a first part of each speech signal segment.

15. The apparatus of claim 14, wherein the logic that synthesizes the lower frequency-band signal based on at least one of the one or more parameters further comprises logic that adaptively changes an amplitude level of the continuous sine tones based on an amplitude level of at least one formant in the narrow-band speech signal segment.

16. The apparatus of claim 15, wherein the at least one formant in the narrow-band speech signal segment is a first formant in the narrow-band speech signal segment.

17. The apparatus of claim 15, wherein the logic that adaptively changes the amplitude level of the continuous sine tones based on the amplitude level of at least one formant in the narrow-band speech signal segment comprises:

logic that adaptively changes an amplitude level of the continuous sine tones by an amount, $g_l(m)$, given by:

$$g_l(m) = C_l \cdot \sqrt{\frac{\sum_{l=0}^{p} a(l)\cdot\gamma_{xx}(l)}{\left|\sum_{l=0}^{p} a(l)\cdot e^{-j2\pi l f_{Nl}}\right|^2}},$$

where $C_l$ is a constant; m is a segment number; $\gamma_{xx}$ is an autocorrelation value of the narrow-band speech signal, x; $f_{Nl}$ is a frequency of a first formant of the narrow-band speech signal; and p is an order of a linear prediction filter.

18. The apparatus of claim 15, wherein the continuous sine tones, s(n), are generated in accordance with:

$$s(n) = \sum_{i=1}^{N} s_i(n),$$

where the summation range i=1 to N is selected such that all sine tones will be added together, and:

$$s_i(n) = \begin{cases} \left(gi(m-1) + n\frac{gi(m) - gi(m-1)}{L_l}\right)\sin\left(i(\phi(m)+n)\left(\omega(m-1) + n\frac{\omega(m)-\omega(m-1)}{L_l}\right)\right), & n = 0, \ldots, L_l \\ gi(m)\sin(i(\phi(m)+n)\omega(m)), & n = L_l + 1, \ldots, L-1 \end{cases}$$

where $\phi(m)$ is a phase compensation needed to maintain a continuous sinusoid within segments, $\omega(m)$ is the pitch frequency of a current speech signal segment m, L is the number of samples in each speech signal segment, and $L_l$ is the end sample of the soft transition within each speech signal segment.

19. The apparatus of claim 11, wherein the logic that synthesizes the lower frequency-band signal based on at least one of the one or more parameters further comprises a lowpass filter that lowpass filters the continuous sine tones.

20. The apparatus of claim 19, wherein the lowpass filter has an upper cutoff frequency substantially equal to 300 Hz.

* * * * *